US007779806B2

(12) United States Patent
Vichinsky

(10) Patent No.: US 7,779,806 B2
(45) Date of Patent: Aug. 24, 2010

(54) AIR INTAKE MANIFOLD INCLUDING A PLENUM REDUCER INSERT

(75) Inventor: Kevin Vichinsky, Portage, MI (US)

(73) Assignee: Mann + Hummel GmbH, Ludwigsburg (DE)

( * ) Notice: Subject to any disclaimer, the term of this patent is extended or adjusted under 35 U.S.C. 154(b) by 0 days.

(21) Appl. No.: 11/968,967

(22) Filed: Jan. 3, 2008

(65) Prior Publication Data

US 2008/0163844 A1 Jul. 10, 2008

Related U.S. Application Data

(60) Provisional application No. 60/878,665, filed on Jan. 5, 2007.

(51) Int. Cl.
*F02M 35/10* (2006.01)

(52) U.S. Cl. ..... 123/184.51; 123/184.42

(58) Field of Classification Search ..... 123/184.47, 123/184.51, 184.55, 184.56, 184.57, 184.61, 123/184.24, 568.17

See application file for complete search history.

(56) References Cited

U.S. PATENT DOCUMENTS

| | | | | |
|---|---|---|---|---|
| 5,636,605 | A * | 6/1997 | Nomizo et al. | 123/184.61 |
| 6,192,850 | B1 * | 2/2001 | Rutschmann et al. | 123/184.57 |
| 6,446,591 | B1 * | 9/2002 | Chae et al. | 123/184.61 |
| 7,117,974 | B2 * | 10/2006 | Moenssen et al. | 181/277 |
| 7,246,593 | B2 * | 7/2007 | Murphy | 123/184.57 |
| 7,357,110 | B2 * | 4/2008 | Hashimoto et al. | 123/184.47 |
| 2004/0200450 | A1 * | 10/2004 | Tanikawa et al. | 123/184.42 |
| 2006/0231054 | A1 * | 10/2006 | Khami et al. | 123/184.53 |

* cited by examiner

*Primary Examiner*—Stephen K Cronin
*Assistant Examiner*—Anthony L Bacon

(57) ABSTRACT

An air intake manifold assembly includes an air intake manifold and a insert that is permanently bonded to an inner surface of the air intake manifold. By bonding the insert to the manifold, a dead space is formed between the insert and the manifold, which reduces the plenum volume within the manifold.

8 Claims, 1 Drawing Sheet

AIR INTAKE MANIFOLD INCLUDING A PLENUM REDUCER INSERT

BACKGROUND OF THE INVENTION

The present invention relates to an air intake system for an internal combustion engine of a motor vehicle.

The air intake manifold of an internal combustion engine channels intake air from the engine's throttle body to the combustion chambers. A typical intake manifold, which can be mounted to a cylinder head of the engine, comprises a plenum and a plurality of runners that distribute airflow from the plenum to the intake ports of each cylinder. For a given air intake manifold, engine performance (e.g., the location of an engine's torque peak in the RPM band) is a function of the volume of the plenum, the cross-sectional area of the runners and, to a lesser extent, the length of the runners.

Conventional air intake manifolds have a fixed air flow geometry. With a fixed air flow geometry, the speed at which intake tuning occurs is also fixed, and the design of such air intake manifolds usually involves a compromise between achieving adequate torque at low speeds and sufficient horsepower at high speeds. In a tuned manifold, for example, the plenum volume, the length of the runners, and the cross-sectional area of the runners can be selected so that a pressure wave formed within the runners has a frequency that optimizes the pressure at each intake port when the corresponding intake valve is open.

One variable used to select the size and dimension of both the plenum and the runners is the engine volume (i.e., the engine displacement). For example, automobile engines can range in size from 2 liter, 4-cylinder models, to 6 liter or even larger 8-cylinder models. The total volume of an air intake manifold, which includes the volume of the plenum and the volume within the runners, is typically about twice the total engine displacement. Because the volume of an air intake manifold is proportional to the engine displacement, a different air intake manifold design is required for each engine size. This relationship results in a large number of different air intake manifold designs and the attendant expense associated with their design and manufacture.

Accordingly, it would be an advantage if a single air intake manifold design could be adapted to fit multiple engine sizes, thus reducing the required number of different air intake manifold designs.

SUMMARY OF THE INVENTION

It is an object of the invention to provide a modular air intake manifold assembly.

Another object of the invention is to provide an air intake manifold configured to have one of a plurality of different internal volumes.

A further object of the invention is to provide an economical air intake manifold.

The air intake manifold of the invention has fitted therein a rigid, volume-reducing insert. The insert, which is preferably a cylindrically-shaped insert, can have any of a variety of cross-sectional shapes along its axial dimension, including circular, oval, square or rectangular. The insert is permanently fitted within the plenum of the air intake manifold and can be sized to produce different plenum volumes for a given air intake manifold design.

According to one embodiment, an air intake manifold assembly comprises a plurality of shell pieces bonded together to define a plenum volume and an insert bonded to an inner surface of one or more of the shell pieces to form a dead space between the insert and the inner surface of the shell pieces.

According to a further embodiment, a method of forming an air intake manifold assembly includes bonding an insert to an inner surface at least one shell piece to define a dead space between the insert and a portion of the inner surface of the at least one shell piece, and bonding the at least one shell piece to one or more shell pieces to form a plenum volume therebetween such that the insert is positioned within the plenum volume.

These and other features of preferred embodiments of the invention, in addition to being set forth in the claims, are also disclosed in the specification and/or in the drawings, and the individual features each may be implemented in embodiments of the invention either individually or in the form of sub-combinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
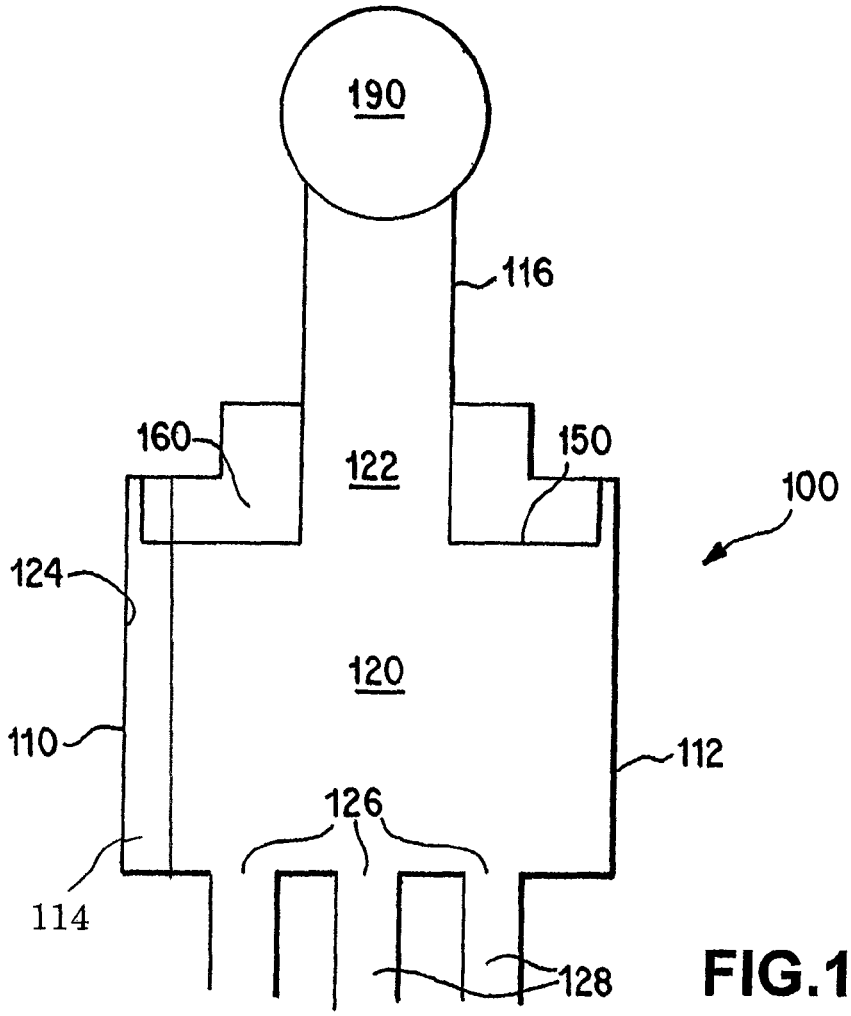
FIG. 1 is a schematic view of a portion of an air intake manifold assembly according to the present invention.

FIG. 1 illustrates a schematic view of an air intake manifold assembly 100. The air intake manifold assembly 100 includes an air intake manifold 110 and an insert 150 for reducing the volume of a plenum 120 within the air intake manifold 110.

The air intake manifold 110 is fabricated using a multi-shell construction and comprises shell piece 112. Two or more shell pieces (not illustrated) can be bonded together to define the air intake manifold 110. As is conventionally known, respective mating pairs of the shell pieces can be bonded together along respective interfaces using a welding process such as vibrational welding.

Referring to FIG. 1, which shows a cross-sectional schematic view of an air intake manifold 100 according to one embodiment, the air intake manifold 100 generally includes an intake conduit 116, which communicates airflow from a throttle body 190 to a plenum 120 within the air intake manifold. The plenum is provided with an inlet region 122 and a plurality of outlets 126. The inlet region 122 is connected to the throttle body 190 via the intake conduit 116. Each outlet 126 is connected to a respective one of a plurality of runners 128. For example, the plenum outlets can be oriented in pairs extending along opposite sides of the plenum. Airflow from the plenum 120 is distributed to each of a plurality of engine cylinders (not shown) via a respective runner 128.

Figure 2:
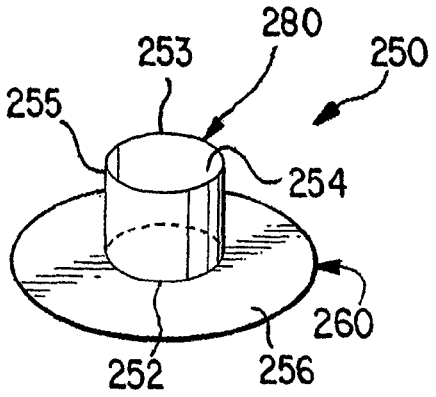
FIG. 2 shows an insert according to one embodiment.
Figure 3:
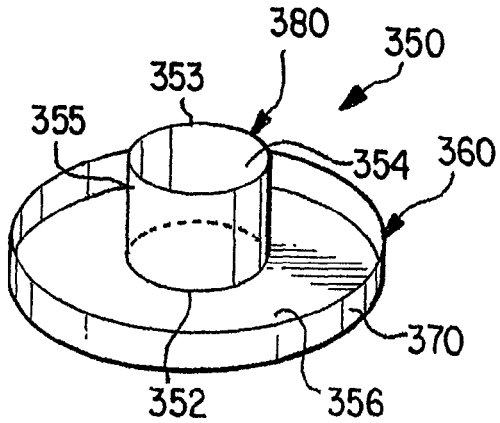
FIG. 3 shows an insert according to a further embodiment.

A rigid, non-porous insert 150 is fitted within the plenum to reduce the air volume therein. By forming a seal between the insert 150 and at least one shell piece, a dead space 160 is formed between the insert and the shell piece. According to one embodiment, the insert 150 is fitted within the inlet region of the plenum. Illustrative inserts are shown in FIGS. 2 and 3. Referring first to FIG. 2, insert 250 has a cylindrical shape and comprises a cylindrical bore 254 defined by cylindrical body 255 and a radially outwardly extending flange 256 located at a first end 252 of the cylindrical body.

The insert 250 also includes a pair of sealing surfaces 260, 280. According to the FIG. 2 embodiment, a first sealing surface 260 is located along a radially-extending, circumferential surface of the outwardly extending flange 256. A second sealing surface 280 is located along an axial-extending circumferential surface located at the second end 253 of the insert. The insert 250 has an L-shaped cross-section.

An insert 350 according to another embodiment is shown in FIG. 3. As with the FIG. 2 insert, the insert 350 comprises a cylindrical bore 354 defined by cylindrical body 355 and a radially extending first flange 356 located at a first end 352 of the cylindrical body. The insert 350 also includes an axially-extending second flange 370 located adjacent the outer circumference of the first radially-extending flange. The axially-extending second flange 370 extends back toward cylindrical body 355 and provides a first sealing surface 360 that is located along an axially-extending, circumferential surface of the second flange 370. As with the FIG. 2 embodiment, insert 350 includes a second sealing surface 380 that is located along an axial-extending circumferential surface located at the second end 353 of the insert. Thus, each half of the insert 350 has a J-shaped cross-section.

The sealing surfaces of an insert are configured to mate with and be bonded to an inner surface of one or more of the shell pieces (e.g., shell piece 112 or 114) that define the plenum. For example, the sealing surfaces of an insert can be bonded to flanged inner surfaces 124 of the plenum. When the air intake manifold is assembled, the insert is secured within the plenum 120. By bonding the insert within to an inner wall of the plenum, a dead space is formed between the insert and the inner wall. Thus, the plenum volume can be reduced by an amount substantially equal to the volume of the dead space.

The invention has the advantage that by using inserts of different size, the volume of the plenum can be adjusted during manufacture of the air intake manifold without modification to the design of the shell pieces. By way of example, an air intake manifold having a total volume suitable for use with a 2.4 liter engine can be easily adapted for use with a 2.2 or 2.0 liter engine by using an appropriately-sized insert.

Permanent bonding of the insert to one of the shell pieces can be accomplished using a welding process such as vibrational welding, friction welding, ultrasonic welding or the like. Each of the shell pieces and the insert are preferably made of a synthetic resin material or of a light metal such as aluminum or an alloy of aluminum. A suitable process for forming the shell pieces and the insert is injection molding.

According to a preferred embodiment, the diameter of the insert's inner bore 254, 354 is greater than or equal to the diameter of the intake conduit 116 so that air flow into and through the plenum is not substantially restricted by the insert.

The foregoing description and examples have been set forth merely to illustrate the invention and are not intended to be limiting. Since modifications of the disclosed embodiments incorporating the spirit and substance of the invention may occur to persons skilled in the art, the invention should be construed broadly to include all variations falling within the scope of the appended claims and equivalents thereof.

What is claimed is:

1. An air intake manifold assembly comprising:
a plurality of shell pieces bonded together to define a plenum volume; and
an insert bonded to an inner surface of at least one of the shell pieces to form a dead space between the insert and the inner surface of one or more of the shell pieces,
wherein the insert has a cylindrical portion and a radially-extending flange portion located at one end thereof, and
wherein the insert further comprises an axially-extending flange located adjacent the outer periphery of the radially-extending flange.

2. The air intake manifold assembly of claim 1, wherein
the insert has a first sealing surface located along an axially-extending surface of the axially-extending flange and
a second sealing surface located along an axial-extending surface at a second end of the insert.

3. The air intake manifold assembly of claim 1, wherein the insert is formed from a synthetic resin material, aluminum or an alloy of aluminum.

4. The air intake manifold assembly of claim 1, wherein the insert is positioned within an inlet region of the plenum volume.

5. A method of forming an air intake manifold assembly comprising the acts of:
forming an insert comprising a cylindrical portion and a radially-extending flange portion located at one end thereof, and wherein the insert further comprises an axially-extending flange located adjacent the outer periphery of the first radially-extending flange,
bonding an insert to an inner surface of at least one shell piece to define a dead space between the insert and a portion of the inner surface of the at least one shell piece, and
bonding the at least one shell piece to one or more shell pieces to form a plenum volume therebetween such that the insert is positioned within the plenum volume.

6. The method of claim 5, wherein the insert is bonded to the at least one shell piece via a first sealing surface located along an axially-extending surface of the axially-extending flange and a second sealing surface located along an axial-extending surface at a second end of the insert.

7. The method of claim 5, wherein the insert is formed from a synthetic resin material, aluminum or an alloy of aluminum.

8. The method of claim 5, wherein the insert is positioned within an inlet region of the plenum volume.

* * * * *